US009715850B2

(12) United States Patent
Xie

(10) Patent No.: US 9,715,850 B2
(45) Date of Patent: Jul. 25, 2017

(54) DISPLAY PANEL OPTICAL COMPENSATING APPARATUS, DISPLAY PANEL AND DISPLAY PANEL OPTICAL COMPENSATING METHOD

(71) Applicant: BOE TECHNOLOGY GROUP CO., LTD., Beijing (CN)

(72) Inventor: Hongjun Xie, Beijing (CN)

(73) Assignee: BOE Technology Group Co., Ltd., Beijing (CN)

( * ) Notice: Subject to any disclaimer, the term of this patent is extended or adjusted under 35 U.S.C. 154(b) by 0 days.

(21) Appl. No.: 14/758,419

(22) PCT Filed: Dec. 18, 2014

(86) PCT No.: PCT/CN2014/094216
§ 371 (c)(1),
(2) Date: Jun. 29, 2015

(87) PCT Pub. No.: WO2015/188605
PCT Pub. Date: Dec. 17, 2015

(65) Prior Publication Data

US 2016/0253960 A1 Sep. 1, 2016

(30) Foreign Application Priority Data

Jun. 12, 2014 (CN) ..... 2014 1 0261438

(51) Int. Cl.
*G09G 3/3225* (2016.01)

(52) U.S. Cl.
CPC ..... *G09G 3/3225* (2013.01); *G09G 2310/08* (2013.01); *G09G 2320/0233* (2013.01);
(Continued)

(58) Field of Classification Search
CPC .... G09G 3/30; G09G 3/3225; G09G 2310/08; G09G 2320/0233
See application file for complete search history.

(56) References Cited

U.S. PATENT DOCUMENTS 6,711,251 B1 * 3/2004 Kieren ..... H04M 3/4228 379/221.13
8,059,070 B2 11/2011 Odawara et al.
(Continued)

FOREIGN PATENT DOCUMENTS

CN 101308298 A 11/2008
CN 101765874 A 6/2010
(Continued)

OTHER PUBLICATIONS

Chinese Office Action in Chinese Application No. 201410261438.5, mailed Nov. 23, 2015 with English translation.
International Search Report with Notice of Transmittal of the International Search Report of PCT/CN2014/094216 in Chinese, mailed Mar. 25, 2015.
(Continued)

*Primary Examiner* — Dennis Joseph
(74) *Attorney, Agent, or Firm* — Collard & Roe, P.C.

(57) ABSTRACT

A display panel optical compensating apparatus, a display panel and a display panel optical compensating method are provided. The display panel optical compensating apparatus comprises a storage unit (1), a data unit (2), a timing control unit (3) and a switch (4). When the switch (4) is in a first position, the timing control unit (3) has no data exchange with the storage unit (1), and the data unit (2) receives compensated data and burns the compensated data into the storage unit (1). When the switch (4) is in a second position, the timing control unit (3) reads the compensated data in the storage unit (1), performs a compensating operation on display data, and outputs compensated display data. The display panel optical compensating apparatus, the display panel and the display panel optical compensating method realize simple structure, flexible operation, high stability, and fast tempo, and are suitable for mass production.

18 Claims, 4 Drawing Sheets

(52) U.S. Cl.
CPC ..... *G09G 2320/0285* (2013.01); *G09G 2320/0295* (2013.01); *G09G 2360/147* (2013.01)

(56) References Cited

U.S. PATENT DOCUMENTS

| | | | | |
|---|---|---|---|---|
| 2007/0200818 | A1* | 8/2007 | Miyamoto | G09G 3/20 345/104 |
| 2008/0238936 | A1 | 10/2008 | Kim | |
| 2010/0253715 | A1* | 10/2010 | Odawara | G09G 3/3233 345/690 |
| 2012/0081381 | A1 | 4/2012 | Kobayashi | |
| 2014/0362071 | A1 | 12/2014 | Jung et al. | |

FOREIGN PATENT DOCUMENTS

| | | | |
|---|---|---|---|
| CN | 102592567 | A | 7/2012 |
| CN | 102768821 | A | 11/2012 |
| CN | 102881257 | A | 1/2013 |
| CN | 104064141 | A | 9/2014 |
| WO | 2013/100733 | A1 | 7/2013 |

OTHER PUBLICATIONS

Written Opinion of the International Searching Authority of PCT/CN2014/094216 in Chinese with English translation mailed Mar. 25, 2015.

* cited by examiner

DISPLAY PANEL OPTICAL COMPENSATING APPARATUS, DISPLAY PANEL AND DISPLAY PANEL OPTICAL COMPENSATING METHOD

CROSS REFERENCE TO RELATED APPLICATIONS

This application is the National Stage of PCT/CN2014/094216 filed on Dec. 18, 2014, which claims priority under 35 U.S.C. §119 of Chinese Application No. 201410261438.5 filed on Jun. 12, 2014, the disclosure of which is incorporated by reference.

TECHNICAL FIELD

Embodiments of the invention relate to a display panel optical compensating apparatus, a display panel and a display panel optical compensating method.

BACKGROUND

An Active Matrix/Organic Light Emitting Diode (AMOLED) television and an AMOLED display module both have a problem of non-uniform displaying, that is, both have a phenomenon of Mura of various traces caused by non-uniformity of brightness of the display. By means of optical measurement, relatively poor uniformity of the brightness of the display can be observed.

An AMOLED is a current type light emitting device, thereby being greatly affected by a current. It is very hard to make the uniformity of a back plate satisfactory due to the limitation of the current process, so that the non-uniformity of the current is caused. The non-uniformity of the current can cause the non-uniformity of the brightness, thereby resulting in the non-uniform displaying of an AMOLED display.

In addition, an Electro Luminescent (EL) process comprise an evaporation deposition type, an ink-jet printing type and the like, and can cause the non-uniformity of electrical characteristics of an OLED, and such non-uniformity will also cause the non-uniformity of screen displaying.

To improve the uniformity of the AMOLED display panel, some compensating technologies can be generally employed to reduce the brightness difference of a screen. An external compensating technology in the compensating technologies is equivalent to a feedback mechanism. FIG. 1 is a schematic diagram of a compensating feedback mechanism in an AMOLED compensating technology. In such compensating technology, the non-uniformity degree of the display panel is detected firstly to form data, and this data is equivalent to a historical file of the corresponding display panel, and reflects a physical attribute of this display panel. Then, the data is transmitted to an image data processing unit, and the image data is corrected by the image data processing unit. The gray scale of image data on an original slightly-bright position of the display panel is reduced to form new image data, and then the new image data is transmitted; the gray scale of image data on an original slightly-dark position of the display panel is increased to form new image data, and the new image data is transmitted. Such processing thought is similar to a negative feedback design in a circuit, that is, the information of an output terminal is reversely transmitted to an input terminal, so that the information of the input terminal is corrected, and finally a dynamic equilibrium is achieved.

An optical compensating technology is one of external compensating technologies. An AMOLED optical compensating apparatus uses an optical CCD device to shoot an illuminated AMOLED display panel to obtain brightness data of each pixel. Then, this apparatus processes and analyzes the obtained brightness data to form burnable data which can be called by a chip. Then, this apparatus burns the data onto a flash chip. It is required to be changed into another set of programs when booting up again; as illustrated in FIG. 2, this program can read the data stored by the flash chip, and stores the data in a Synchronous Dynamic Random Access Memory (SDRAM). When the screen normally works, the data in the SDRAM is read at any time for processing input image data so as to form compensated data, and the compensated data is transmitted to the AMOLED display panel.

SUMMARY

Embodiments of the invention provide a display panel optical compensating apparatus, a display panel and a display panel optical compensating method to avoid tedious operations of the optical compensating method and are suitable for mass production.

At least one embodiment of the invention provides a display panel optical compensating apparatus which comprises a storage unit, a data unit, a timing control unit and a switch. The switch is configured to be able to be switched between a first position and a second position. Upon the switch being in the first position, the timing control unit works in a non-compensation mode and has no data exchange with the storage unit, and the data unit receives compensated data and burns the compensated data into the storage unit. Upon the switch being in the second position, the timing control unit works in a compensation mode, reads the compensated data in the storage unit, performs a compensating operation on display data which is to be displayed on a display panel, and outputs compensated display data.

For example, in one embodiment, the storage unit, the data unit, the timing control unit and the switch are all distributed on one circuit board.

For example, in one embodiment, the storage unit is a flash chip.

For example, in one embodiment, the apparatus further comprises: a first level output terminal and a second level output terminal, which output different levels; the switch is a double-pole double-throw switch. A first pole of the double-pole double-throw switch connects the timing control unit and the first level output terminal upon being in the first position, and connects the timing control unit and the second level output terminal upon being in the second position, so as to control working modes of the timing control unit. A second pole of the double-pole double-throw switch connects the storage unit and the data unit upon being in the first position, and connects the storage unit and a power supply upon being in the second position, so as to switch between control power supplies of the storage unit.

For example, in one embodiment, the first level output terminal is a ground point, and the second level output terminal is a high-level output terminal led out from the timing control unit.

For example, in one embodiment, the apparatus further comprises: a camera unit and a processing unit, the processing unit being respectively connected with the camera unit and the data unit. The camera unit is configured to obtain non-uniformity degree information of the display panel, and transfer the non-uniformity degree information to the processing unit; the processing unit is configured to analyze and correct the non-uniformity degree information, calculate negative feedback information of the non-uniformity degree information to form the compensated data, and transfer the compensated data to the data unit.

For example, in one embodiment, the camera unit comprises a CCD image sensing element.

For example, in one embodiment, the storage unit is respectively connected with the data unit and the timing control unit via a control and data bus.

Another embodiment of the invention further provides a display panel comprising the display panel optical compensating apparatus in accordance with any of the embodiments as mentioned above.

Still another embodiment of the invention further provides a display panel optical compensating method using the display panel optical compensating apparatus in accordance with any of the embodiments as mentioned above, comprising:

placing the switch in the first position, such that the timing control unit runs in the non-compensation mode, the data unit receives the compensated data and burns the compensated data into the storage unit;

placing the switch in the second position, such that the timing control unit runs in the compensation mode, reads the compensated data in the storage unit, performs the compensating operation on the display data which is to be displayed on the display panel, and outputs the compensated display data.

For example, in one embodiment, the method further comprises:

obtaining the non-uniformity degree information of the display panel by a camera unit; analyzing and correcting the non-uniformity degree information and calculating the negative feedback information of the non-uniformity degree information by a processing unit, so as to form the compensated data.

BRIEF DESCRIPTION OF THE DRAWINGS

In order to clearly illustrate the technical solution of the embodiments of the invention, the drawings of the embodiments will be briefly described in the following; it is obvious that the described drawings are only related to some embodiments of the invention and thus are not limitative of the invention.

DETAILED DESCRIPTION

In order to make objects, technical solutions and advantages of the embodiments of the invention more apparent, the technical solutions of the embodiment will be described in a clearly and fully understandable way in connection with the drawings related to the embodiments of the invention. It is obvious that the described embodiments are just a part but not all of the embodiments of the invention. Based on the described embodiments herein, those skilled in the art can obtain all other embodiment(s), without any inventive work, which should be within the scope of the invention.

The inventor has noticed that because the optical compensating technology is required to shoot brightness data and burn a chip, two sets of programs are required and operations are tedious in this process, so that mass production can not be realized.

Figure 1:
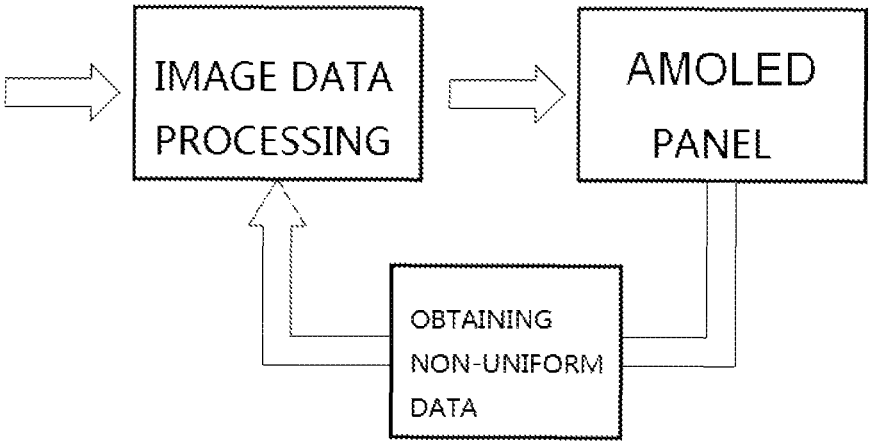
FIG. 1 is a schematic diagram of a compensating feedback mechanism in an AMOLED compensating technology.
Figure 2:
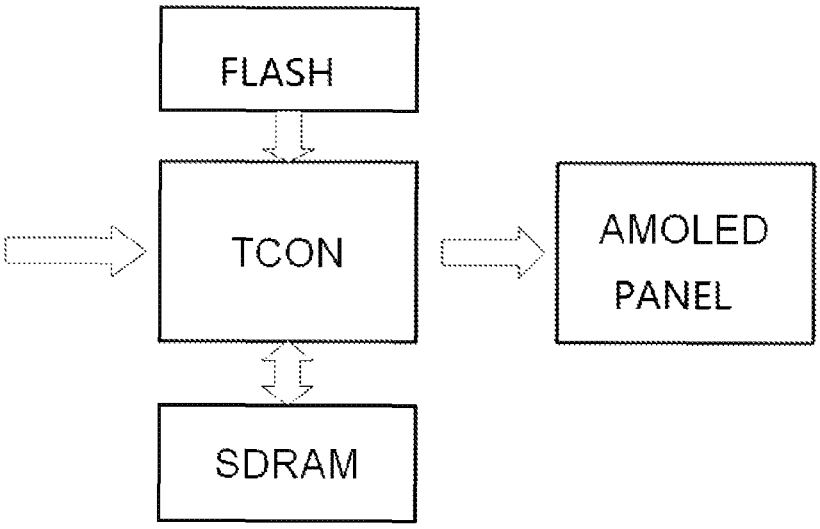
FIG. 2 is a schematic diagram of an AMOLED compensating apparatus.
Figure 3:
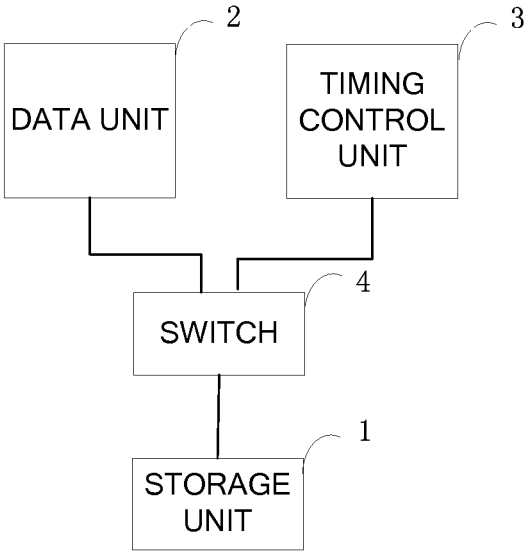
FIG. 3 is a schematic diagram of a basic structure of a display panel optical compensating apparatus according to an embodiment of the invention.

At least one embodiment of the invention provides a display panel optical compensating apparatus, which comprises a storage unit 1, a data unit 2, a timing control unit 3 and a switch 4, as illustrated in FIG. 3.

For example, upon the switch 4 being in a first position, the timing control unit 3 works in a non-compensation mode and has no data exchange with the storage unit 1, the data unit 2 receives compensated data and burns the compensated data into the storage unit 1; upon the switch 4 being in a second position, the timing control unit 3 works in a compensation mode, reads the compensated data in the storage unit 1, performs a compensating operation on display data which is to be displayed on a display panel, and outputs compensated display data.

For example, the storage unit 1, the data unit 2, the timing control unit 3 and the switch 4 can be all distributed on one circuit board.

For example, the storage unit 1 can be a flash chip.

For example, the display panel optical compensating apparatus can further comprise: a first level output terminal and a second level output terminal, which output different levels; the switch 4 can be a double-pole double-throw switch. For example, a first pole of the double-pole double-throw switch connects the timing control unit 3 and the first level output terminal upon being in the first position, and connects the timing control unit 3 and the second level output terminal upon being in the second position, so as to control the switching of working modes of the timing control unit 3 according to a voltage change. A second pole of the double-pole double-throw switch connects the storage unit 1 and the data unit 2 upon being in the first position, and connects the storage unit 1 and a power supply upon being in the second position, so as to switch between control power supplies of the storage unit 1.

For example, the first level output terminal can be a ground point. For example, the second level output terminal can be a high-level output terminal led out from the timing control unit 3.

For example, in the non-compensation mode, the storage unit 1 is powered by the data unit 2, and is at a low level; in the compensation mode, the storage unit 1 is at a high level. For example, in the compensation mode, the power supply connected by the second pole of the double-pole double-throw switch can be output from the timing control unit 3.

Figure 4:
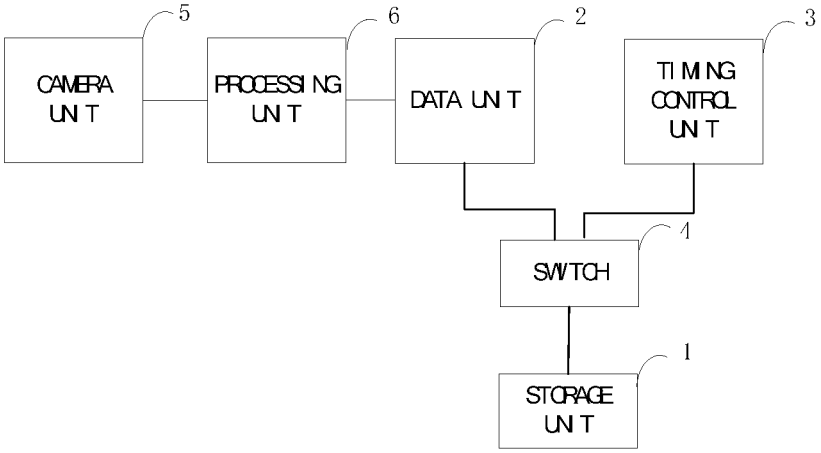
FIG. 4 is a schematic diagram of another structure of a display panel optical compensating apparatus according to an embodiment of the invention.

For example, the display panel optical compensating apparatus can further comprise: a camera unit 5 and a processing unit 6, wherein the processing unit 6 is respectively connected with the camera unit 5 and the data unit 2, as illustrated in FIG. 4. The camera unit 5 is configured to obtain non-uniformity degree information of the display panel, and transfer the non-uniformity degree information to the processing unit 6; the processing unit 6 is configured to analyze and correct the non-uniformity degree information, calculate negative feedback information of the non-uniformity degree information to form the compensated data, and transfer the compensated data to the data unit 2.

For example, the camera unit 5 can comprise a CCD image sensing element. The display panel optical compensating apparatus can shoot the illuminated display panel through a CCD, and then perform data processing by the processing unit to form the compensated data. Alternatively, the camera unit 5 can comprise a CMOS image sensing element.

For example, the storage unit 1 is respectively connected with the data unit 2 and the timing control unit 3 via a control and data bus.

For example, the data unit 2 can be a CON interface, but not limited to this.

For example, the timing control unit 3 can be a TCON chip, but not limited to this.

The display panel optical compensating apparatus provided by the embodiment of the invention can be connected to an AMOLED panel by the timing control unit 3, and output the compensated display data to the AMOLED panel so as to realize the optical compensating output of negative feedback of the display data, thereby obtaining a compensated display picture on the AMOLED panel.

An embodiment of the invention further provides a display panel comprising the display panel optical compensating apparatus in accordance with any embodiments as mentioned above.

For example, the display panel provided by the embodiment of the invention can be an electronic paper, a mobile phone, a tablet computer, a television, a display, a notebook computer, a digital photo frame, a navigator any other products or parts having the display function.

The display panel optical compensating apparatus provided by the embodiment of the invention can be of multiple forms, as long as it has the above-mentioned units and components. Those skilled in the art can implement the above-mentioned units and components by hardware, software, firmware, or a combination thereof, so as to form the apparatus and the display panel provided by the embodiments of the invention.

An embodiment of the invention further provides an optical compensating method using the display panel optical compensating apparatus in accordance with any embodiments as mentioned above, and the method comprises following steps:

step 501: placing the switch in the first position, such that the timing control unit runs in the non-compensation mode, and the data unit receives the compensated data and burns the compensated data into the storage unit;

step 502: placing the switch in the second position, such that the timing control unit runs in the compensation mode, reads the compensated data in the storage unit, performs the compensating operation on the display data which is to be displayed on the display panel, and outputs the compensated display data.

Hereinafter, a specific implementing process of the embodiment of the invention is explained in detail with operation steps of a display panel optical compensating method as an example.

Step 601: installing a flash chip on a circuit board to form a circuit structure.

In this step, under an original delivery state, the flash chip can be directly installed on the circuit board. The flash chip serves as the storage unit, and data inside the storage unit is random data, that is, invalid data.

Step 602: placing the double-pole double-throw switch in the first position, such that a TCON chip (timing control unit) works in the non-compensation mode and has no data exchange with the flash chip; a CON interface (data unit) obtains non-uniformity degree information of the display panel through a CCD so as to obtain the compensated data, and burns the compensated data into the flash chip.

Figure 5:
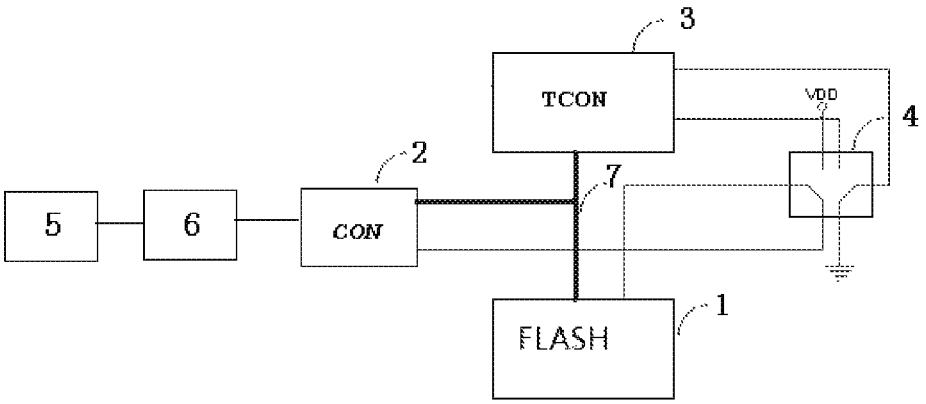
FIG. 5 is a schematic diagram of connection of a display panel optical compensating apparatus used by a display panel optical compensating method according to an embodiment of the invention in a non-compensation mode.
Figure 7:
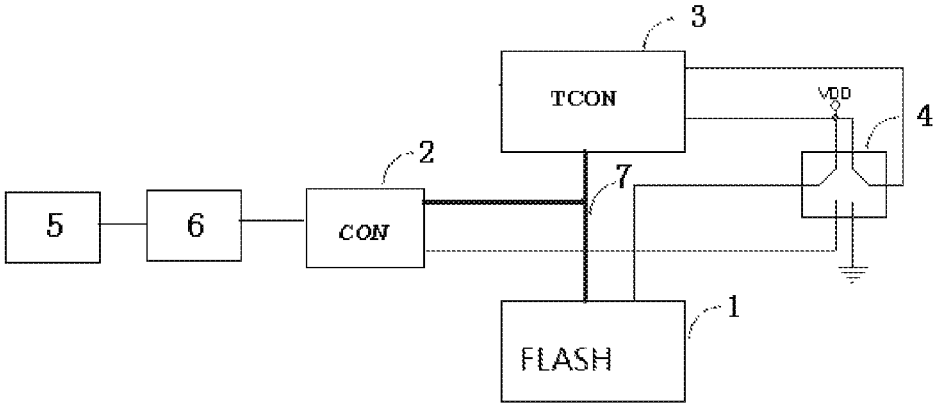
FIG. 7 is a schematic diagram of connection of the display panel optical compensating apparatus used by the display panel optical compensating method according to the embodiment of the invention in a compensation mode.

FIGS. 5 and 7 respectively illustrate schematic diagrams of connections of a display panel optical compensating apparatus used by the display panel optical compensating method provided by this embodiment in the non-compensation mode and in the compensation mode. As illustrated in FIGS. 5 and 7, 7 represents the control and data bus, and the double-pole double-throw switch 4 is configured to respectively switch between the working modes of the TCON chip 3 and the power supplies of the flash chip 1.

Figure 6:
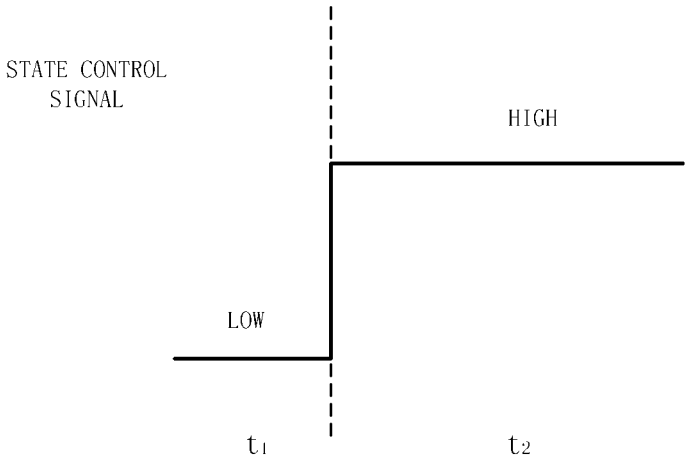
FIG. 6 is a timing control diagram of a state control signal in the display panel optical compensating method according to the embodiment of the invention.

In the initial runtime, the double-pole double-throw switch 4 is firstly placed in the first position to ensure that the first pole makes the TCON chip (timing control unit) 3 be connected with the first level output terminal, and the second pole makes the flash chip (storage unit) 1 be connected with the CON interface (data unit) 2. As illustrated in FIG. 5, the TCON chip 3 is grounded by the double-pole double-throw switch 4; a state control signal is Low as illustrated at time t1 in the timing control diagram of the state control signal in FIG. 6, it represents working in the non-compensation mode. The flash chip 1 is directly connected with the CON interface 2. When the state control signal is Low, the TCON chip 3 outputs a high impedance state on the control and data bus 7 connected with the flash chip 1, and the control right of the flash chip 1 is taken over by the CON interface 2. In this way, the power supply of the flash chip 1 is supplied via the CON interface, and because the CON interface has no any other connections except connections illustrated in the diagrams, no power is supplied to the flash chip 1.

Then, the CCD is started to obtain the non-uniformity degree information of the display panel. Then, the processing unit 6 analyzes and corrects the non-uniformity degree information, calculates negative feedback information of the non-uniformity degree information to form the compensated data, and transfers the compensated data to the CON interface.

The CON interface 2 is connected with the processing unit 6 via a downloading wire. In the non-compensation mode, the control and data bus of the flash chip 1 is connected with the CON interface, and the power supply of the flash chip 1 is supplied via the CON interface; at this time, the compensated data received by the CON interface is burned into the flash chip by a PC, and the random data under the original delivery state is covered.

Step 603: placing the double-pole double-throw switch in the second position to ensure that the TCON chip works in the compensation mode, and reads the compensated data in the flash chip, performs the compensating operation, and outputs the compensated display data.

In this step, the double-pole double-throw switch 4 is switched to the second position, such that the first pole makes the TCON chip be connected with the second level output terminal and the second pole makes the flash chip be connected with the power supply. As illustrated in FIG. 7, the TCON chip 3 is connected to the high-level output terminal led out from the TCON chip, that is, a power supply VDD output by the TCON chip, by means of the double-pole double-throw switch; the state control signal turns into High as illustrated at time t2 in FIG. 6, it represents that the timing control unit, i.e., the TCON chip works in the compensation mode. The flash chip is directly connected to the power supply VDD led out from the TCON chip, and is powered by the power supply VDD.

At this moment, the downloading wire between the CON interface and the computer is disconnected, the timing control unit works in the compensation mode, and the TCON chip reads data from the flash chip, performs the compensating operation, and then outputs the compensated display data to the AMOLED panel, so as to obtain the compensated display picture.

So far, the whole process of the display panel optical compensating method provided by the embodiment of the invention is completed.

In the display panel optical compensating apparatus, the display panel and the display panel optical compensating method provided by the embodiments of the invention, the timing control unit can work in two modes by controlling the switch. In the non-compensation mode, the compensated data is burned into the storage unit; in the compensation mode, the compensated data is read to compensate the display data, and the compensated display data is output. The embodiments of the invention performs mode switching without booting up again; the apparatus has simple structure, flexible operation, high stability, and fast tempo, and is suitable for mass production.

The foregoing embodiments are merely used for explaining the technical solution of the invention, and not intended to limit the invention; although the invention is explained in detail with reference to the foregoing embodiments, those of ordinary skill in the art will readily appreciate that many modifications are possible in the foregoing embodiments, or equivalent substitutions are made for part of technical features; however, these modifications or substitutions are not intended to make the essences of the corresponding technical solutions depart from the spirit and the scope of the technical solutions of the embodiments of the invention.

The present application claims priority of Chinese Patent Application No. 201410261438.5 filed on Jun. 12, 2014, the disclosure of which is incorporated herein by reference in its entirety as part of the present application.

What is claimed is:

1. A display panel optical compensating apparatus, comprising: a storage unit, a data unit, a timing control unit and a switch, wherein the switch is configured to be able to switch between a first position and a second position;

wherein upon the switch being in the first position, the timing control unit works in a non-compensation mode and has no data exchange with the storage unit, the data unit receives compensated data and burns the compensated data into the storage unit;

wherein upon the switch being in the second position, the timing control unit works in a compensation mode, reads the compensated data in the storage unit, performs a compensating operation on display data which is to be displayed on a display panel, and outputs compensated display data;

wherein the display panel optical compensating apparatus further comprises a first level output terminal and a second level output terminal, the first level output terminal is a ground point, and the second level output terminal is a power supply output terminal from the timing control unit;

wherein the switch is a double-pole double-throw switch;

wherein upon the switch being in the first position:

a first pole of the double-pole double-throw switch connects the timing control unit to the ground point, so that a state control signal with a first value is produced and configured to control the timing control unit to work in the non-compensation mode; and a second pole of the double-pole double-throw switch connects the storage unit to the data unit, so that no power is supplied to the storage unit; and wherein upon the switch being in the second position:

the first pole of the double-pole double-throw switch connects the timing control unit to the power supply output terminal, so that the state control signal with a second value is produced and configured to control the timing control unit to work in the compensation mode; and the second pole of the double-pole double-throw switch connects the storage unit to the same power supply output terminal to supply power to the storage unit.

2. The display panel optical compensating apparatus according to claim 1, wherein, the storage unit, the data unit, the timing control unit and the switch are all distributed on one circuit board.

3. The display panel optical compensating apparatus according to claim 2, the storage unit is a flash chip.

4. The display panel optical compensating apparatus according to claim 2, wherein a second pole of the double-pole double-throw switch connects the storage unit and the data unit upon the switch being in the first position, and connects the storage unit and a power supply upon the switch being in the second position, so as to switch between control power supplies of the storage unit.

5. The display panel optical compensating apparatus according to claim 4, wherein, the first level output terminal is a ground point, and the second level output terminal is a high-level output terminal led out from the timing control unit.

6. The display panel optical compensating apparatus according to claim 2, further comprising: a camera unit and a processing unit, the processing unit being respectively connected with the camera unit and the data unit, wherein, the camera unit is configured to obtain non-uniformity degree information of the display panel, and transfer the non-uniformity degree information to the processing unit;

the processing unit is configured to analyze and correct the non-uniformity degree information, calculate negative feedback information of the non-uniformity degree information to form the compensated data, and transfer the compensated data to the data unit.

7. The display panel optical compensating apparatus according to claim 1, wherein the storage unit is a flash chip.

8. The display panel optical compensating apparatus according to claim 7, wherein a second pole of the double-pole double-throw switch connects the storage unit and the data unit upon the switch being in the first position, and connects the storage unit and a power supply upon the switch being in the second position, so as to switch between control power supplies of the storage unit.

9. The display panel optical compensating apparatus according to claim 8, wherein, the first level output terminal is a ground point, and the second level output terminal is a high-level output terminal led out from the timing control unit.

10. The display panel optical compensating apparatus according to claim 7, further comprising: a camera unit and a processing unit, the processing unit being respectively connected with the camera unit and the data unit, wherein, the camera unit is configured to obtain non-uniformity degree information of the display panel, and transfer the non-uniformity degree information to the processing unit;

the processing unit is configured to analyze and correct the non-uniformity degree information, calculate negative feedback information of the non-uniformity degree information to form the compensated data, and transfer the compensated data to the data unit.

11. The display panel optical compensating apparatus according to claim 1, further comprising: a camera unit and a processing unit, the processing unit being respectively connected with the camera unit and the data unit, wherein, the camera unit is configured to obtain non-uniformity degree information of the display panel, and transfer the non-uniformity degree information to the processing unit;

the processing unit is configured to analyze and correct the non-uniformity degree information, calculate negative feedback information of the non-uniformity degree information to form the compensated data, and transfer the compensated data to the data unit.

12. The display panel optical compensating apparatus according to claim 11, wherein, the camera unit comprises a CCD image sensing element.

13. The display panel optical compensating apparatus according to claim 1, wherein, the storage unit is respectively connected with the data unit and the timing control unit via a control and data bus.

14. A display panel, comprising the display panel optical compensating apparatus according to claim 1.

15. A display panel optical compensating method, using the display panel optical compensating apparatus according to claim 1, comprising:

placing the switch in the first position, such that the timing control unit runs in the non-compensation mode, and the data unit receives the compensated data and burns the compensated data into the storage unit; and placing the switch in the second position, such that the timing control unit runs in the compensation mode, reads the compensated data in the storage unit, performs the compensating operation on the display data which is to be displayed on the display panel, and outputs the compensated display data.

16. The display panel optical compensating method according to claim 15, wherein the display panel optical compensating apparatus further comprises: a camera unit and a processing unit, the processing unit being respectively connected with the camera unit and the data unit, wherein, the camera unit is configured to obtain non-uniformity degree information of the display panel, and transfer the non-uniformity degree information to the processing unit; the processing unit is configured to analyze and correct the non-uniformity degree information, calculate negative feedback information of the non-uniformity degree information to form the compensated data, and transfer the compensated data to the data unit, wherein the display panel optical compensating method further comprises:

obtaining the non-uniformity degree information of the display panel by the camera unit; analyzing and correcting the non-uniformity degree information, and calculating the negative feedback information of the non-uniformity degree information by the processing unit, so as to form the compensated data.

17. The display panel optical compensating apparatus according to claim 1, further comprising: a camera unit and a processing unit, the processing unit being respectively connected with the camera unit and the data unit, wherein, the camera unit is configured to obtain non-uniformity degree information of the display panel, and transfer the non-uniformity degree information to the processing unit;

the processing unit is configured to analyze and correct the non-uniformity degree information, calculate negative feedback information of the non-uniformity degree information to form the compensated data, and transfer the compensated data to the data unit.

18. The display panel optical compensating apparatus according to claim 1, further comprising: a camera unit and a processing unit, the processing unit being respectively connected with the camera unit and the data unit, wherein, the camera unit is configured to obtain non-uniformity degree information of the display panel, and transfer the non-uniformity degree information to the processing unit;

the processing unit is configured to analyze and correct the non-uniformity degree information, calculate negative feedback information of the non-uniformity degree information to form the compensated data, and transfer the compensated data to the data unit.

* * * * *